US006123612A

United States Patent [19]

Goers

[11] Patent Number: 6,123,612

[45] Date of Patent: Sep. 26, 2000

[54] CORROSION RESISTANT ABRASIVE ARTICLE AND METHOD OF MAKING

[75] Inventor: Brian D. Goers, Minneapolis, Minn.

[73] Assignee: 3M Innovative Properties Company, St. Paul, Minn.

[21] Appl. No.: 09/060,634

[22] Filed: Apr. 15, 1998

[51] Int. Cl.[7] ..... B24B 5/00

[52] U.S. Cl. ..... 451/540; 451/548; 451/541; 51/295

[58] Field of Search ..... 51/295, 298, 307, 51/309; 451/540, 541, 548, 551, 552

[56] References Cited

U.S. PATENT DOCUMENTS

| | | | |
|---|---|---|---|
| 4,018,576 | 4/1977 | Lowder et al. . | |
| 4,042,559 | 8/1977 | Abelson et al. | 51/298 |
| 4,311,489 | 1/1982 | Kressner . | |
| 4,378,975 | 4/1983 | Tomlinson et al. | 51/309 |
| 4,621,031 | 11/1986 | Scruggs | 51/307 |
| 4,652,275 | 3/1987 | Bloecher et al. . | |
| 4,799,939 | 1/1989 | Bloecher et al. . | |
| 4,925,457 | 5/1990 | deKok et al. . | |
| 5,000,273 | 3/1991 | Horton et al. | 76/108.2 |
| 5,049,165 | 9/1991 | Tselesin . | |
| 5,131,924 | 7/1992 | Wiand | 51/309 |
| 5,203,881 | 4/1993 | Wiand | 51/309 |
| 5,251,802 | 10/1993 | Bruxvoort et al. . | |
| 5,264,011 | 11/1993 | Brown et al. . | |
| 5,380,390 | 1/1995 | Tselesin . | |
| 5,486,131 | 1/1996 | Cesna et al. . | |
| 5,492,188 | 2/1996 | Smith et al. | 76/108.2 |
| 5,511,718 | 4/1996 | Lowder et al. . | |
| 5,569,062 | 10/1996 | Karlsrud . | |
| 5,707,276 | 1/1998 | Holko et al. | 451/551 |
| 5,781,060 | 2/1999 | Jensen et al. | 175/430 |
| 5,782,679 | 7/1998 | Hunter | 451/296 |
| 5,833,021 | 11/1998 | Mensa-Wilmot et al. | 51/295 |

*Primary Examiner*—M. Rachuba
*Attorney, Agent, or Firm*—Scott R. Pribnow

[57] ABSTRACT

An abrasive article includes a plurality of abrasive particles securely affixed to a substrate with a corrosion resistant matrix material. The matrix material includes a sintered corrosion resistant powder and a brazing alloy. The brazing alloy includes an element which reacts with and forms a chemical bond with the abrasive particles, thereby securely holding the abrasive particles in place. A method of forming the abrasive article includes arranging the abrasive particles in the matrix material, and applying sufficient heat and pressure to the mixture of abrasive particles and matrix material to cause the corrosion resistant powder to sinter, the brazing alloy to flow around, react with, and form chemical bonds with the abrasive particles, and allow the brazing alloy to flow through the interstices of the sintered corrosion resistant powder and form an inter-metallic compound therewith.

15 Claims, 2 Drawing Sheets

CORROSION RESISTANT ABRASIVE ARTICLE AND METHOD OF MAKING

FIELD OF THE INVENTION

The present invention relates generally to abrasive articles. More particularly, the present invention relates to an abrasive article wherein the abrasive particles are affixed to a substrate with a corrosion resistant matrix material including a sintered corrosion resistant powder and a brazing alloy chemically bonded with the abrasive particles, thereby securely holding the particles in place, and further relates to a method of making such an abrasive article.

BACKGROUND OF THE INVENTION

Abrasive articles, such as polishing or conditioning disks, are generally formed by affixing abrasive particles to a carrier or substrate with a matrix material. Such abrasive articles are used to smooth or polish the surface of a workpiece, such as a urethane pad, which may, in turn, be used to polish components, such as silicon wafers. Conditioning disks are used in a wide variety of environments including highly corrosive environments which degrade the structural integrity of the article. Thus, if the abrasive particles are not adequately secured to the substrate, the particles will have a tendency to become dislodged from the matrix material. Once dislodged, an abrasive particle can easily scratch and damage the polished surface of the workpiece. In addition, once one particle is dislodged, support for adjacent particles is decreased, and additional particles are more likely to become dislodged. Accordingly, a conditioning disk which maintains its strength, wear resistance, and structural integrity in a corrosive environment is highly desirable.

Various techniques have been used to affix abrasive particles to a substrate. Each technique includes surrounding the abrasive particles with a matrix material which forms a bond between the particles and substrate, thereby serving to hold the particles in place. One such known technique is electroplating which includes depositing a metal, typically nickel, to a thickness in the range of 40–75% of the height of the particle, thereby forming a bond with the abrasive particles which is a purely mechanical attachment. The Bruxvoort et al. U.S. Pat. No. 5,251,802, for example, discloses an abrasive article including a plurality of abrasive composites bonded to a backing. Each of the abrasive composites includes a plurality of abrasive grains, such as diamond or cubic boron nitride, and a preferably metallic binder of tin, bronze, nickel, silver, iron, and alloys or combinations thereof for securing the abrasive grains to the backing. The binder is applied to the backing by an electroplating process and the abrasive grains are applied simultaneously during the electroplating process. Electroplating is limited in that not all abrasive particles form adequate bonds with electro-deposited metal. In addition, not all metals are capable of electrodeposition, therefore limiting the range of metallic compositions which can be used in the electroplating process.

Another known technique for affixing abrasive particles to a substrate is by sintering the matrix material. Sintering involves applying heat and/or pressure to a fusible matrix material containing abrasive particles, thereby serving to affix the abrasive particles to the substrate. The Tselesin U.S. Pat. No. 5,380,390, for example, discloses an abrasive article and method in which the abrasive particles are affixed to a substrate by a sinterable or fusible matrix material. The Lowder et al. U.S. Pat. No. 5,511,718 discloses a process of brazing diamond to create monolayer tools with a nickel-chromium-boron alloy. While sintering generally serves to affix the abrasive particles to the substrate, the abrasive particles have a tendency to become dislodged from the matrix material during operation, particularly in a corrosive environment. Thus, there exists the need for a corrosion resistant abrasive article in which the abrasive particles remain affixed to the substrate over extended periods of operation under adverse operating conditions.

SUMMARY OF THE INVENTION

The present invention provides an abrasive article for use in a corrosive environment, and a method of making such an abrasive article. More particularly, the present invention provides an abrasive article in which the abrasive particles are affixed to one or both sides of a substrate using a corrosion resistant matrix material which forms a chemical bond as well as a mechanical attachment with the abrasive particles, thereby securely holding the particles in place on the substrate in a wide variety of operating conditions. The substrate may be a separate component to which the abrasive particle and matrix material composite is affixed, or the substrate may be formed integrally of matrix material.

The size and type of abrasive particles are selected to achieve the desired characteristics of the abrasive article depending on its intended application. The term "abrasive particles" includes single abrasive particles bonded together by a binder to form an abrasive agglomerate or composite. Abrasive agglomerates are further described in U.S. Pat. No. 4,311,489 to Kressner, U.S. Pat. No. 4,652,275 to Bloecher et al., and U.S. Pat. No. 4,799,939 to Bloecher et al. The abrasive particles may further include a surface treatment or coating, such as a coupling agent or a metal or ceramic coating. Abrasive particles useful in the present invention have an average size of generally 20 to 1000 micrometers. More specifically, the abrasive particles have an average size of about 45 to 625 micrometers, or about 75 to 300 micrometers. Occasionally, abrasive particle sizes are reported in terms of "mesh" or "grade," both of which are commonly known abrasive particle sizing methods. It is preferred that the abrasive particles have a Mohs hardness of at least 8 and, more preferably, at least 9. Suitable abrasive particles include, for example, fused aluminum oxide, ceramic aluminum oxide, heat treated aluminum oxide, silicon carbide, boron carbide, tungsten carbide, alumina zirconia, iron oxide, diamond (natural and synthetic), ceria, cubic boron nitride, garnet, carborundum, boron suboxide, and combinations thereof.

In accordance with a characterizing feature of the invention, the matrix material includes a brazing alloy and a sintered corrosion resistant powder. When heated to a pre-determined temperature, the brazing alloy becomes liquid and flows around the abrasive particles. In addition, the brazing alloy reacts with and forms a chemical bond with the abrasive particles. In order to form the chemical bond, the composition of the brazing alloy includes a pre-selected element known to react with the particular abrasive particle, thereby forming the chemical bond. For example, if diamond abrasive particles are used, the brazing alloy may include at least one of the following elements which may react and form a chemical bond with the diamond: chromium, tungsten, cobalt, titanium, zinc, iron, manganese, or silicon. By way of further example, if cubic boron nitride abrasive particles are used, the brazing alloy may include at least one of aluminum, boron, carbon and silicon which may form the chemical bond with the abrasive particles, and if aluminum oxide abrasive particles are used, the brazing alloy may include at least one of aluminum, boron, carbon, and silicon. It will be recognized, however, that the brazing alloy may also contain various inert elements in addition to the element or elements which react with and form the chemical bond with the abrasive particles.

A quantity of corrosion resistant powder is admixed with the brazing alloy to improve the bonding properties, enhance the strength, improve the corrosion resistant properties, and reduce the cost of the matrix material. The corrosion resistant powder may include metals and metal alloys including stainless steel, titanium, titanium alloys, zirconium, zirconium alloys, nickel, and nickel alloys. More specifically, the nickel alloy can include nichrome, a nickel alloy including 80% nickel and 20% chrome by weight. Alternatively, the corrosion resistant powder can be formed of ceramics including carbides, such as silicon or tungsten carbide.

In one embodiment, the substrate is formed of stainless steel and is affixed to a support carrier in the form of a stainless steel shim using an epoxy film. It will be apparent, however, that both the substrate and carrier may be formed of other materials such as, for example, synthetic plastic materials, ceramic materials, or other suitable corrosion resistant metals. It will also be apparent that the substrate and carrier can be connected with any suitable fastening technique including adhesive or mechanical fasteners.

In another embodiment of the invention, the carrier is formed of a polycarbonate material, such as LEXAN™, and has a generally annular shape with a plurality of gear teeth included along its outer edge surface. The abrasive particles and matrix material are formed into abrasive segments which are affixed directly to the carrier with suitable fastening means. Each segment includes an abrasive portion containing the abrasive particles and an in situ substrate portion formed entirely of matrix material.

To reduce the likelihood of abrasive particles breaking loose from the substrate in the region where the substrate is cut to the desired shape, the portion of the substrate which is cut may be provided free of abrasive particles. This particle free zone may, for example, extend a certain distance along the entire edge of the substrate. For a typical conditioning disk having a generally circular or annular shape, the particle free zone is provided at the outer peripheral edge portion of the substrate. Depending on the application, abrasive particles can be provided on one or both sides of the substrate.

The present invention further provides a method of fabricating an abrasive article in which the abrasive particles are affixed to a substrate with a corrosion resistant matrix material including a brazing alloy and a corrosion resistant powder. The method includes first applying a layer of matrix material to the substrate and then arranging the abrasive particles in the matrix material so that a portion of each abrasive particle is surrounded by matrix material. The abrasive particles are arranged on the substrate to provide a particle free zone, thereby eliminating the problem of having abrasive particles in that zone becoming loose as a result of weakness caused by the cutting process. Next, the matrix material is treated with heat and/or pressure to cause the brazing alloy to become liquid and flow between the abrasive particles and between the interstices of the corrosion resistant powder. During this step the brazing alloy forms a chemical bond with the abrasive particles, and forms an inter-metallic compound at the interface with the corrosion resistant powder, thereby bonding the brazing alloy with the corrosion resistant powder. In addition, the combination of heat and pressure causes the corrosion resistant powder to sinter.

During the heating and pressurizing step, the article is heated to a temperature in the range of generally between 500 and 1200 degrees Celsius and pressurized to a pressure in the range of generally between 75 and 400 kg/cm$^2$, and is maintained at this temperature and pressure for a time period sufficient to allow the brazing alloy to form the chemical bond with the abrasive particles, to allow the brazing alloy to form the inter-metallic compound with the corrosion resistant powder, and to allow the powder to sinter. A time period of generally between 3 and 15 minutes has been found to be sufficient.

A more specific method of applying heat and pressure to the article includes covering the abrasive particles and matrix material with a layer of material such as, for example, graphite paper, which is electrically conductive and conforms to the contours of the abrasive surface. This method requires the additional step of removing the conductive layer using known techniques such as, for example, sandblasting, pressure washing with water, high pressure waterjet cleaning, or chemically dissolving the layer to expose the abrasive particles following the heat and pressure treatment.

The method of forming the invention may also include the additional steps of cutting the article through the particle free zone to a desired shape such as, for example, an annular disk shape; flattening the article; cleaning the article; and attaching the article to a carrier.

BRIEF DESCRIPTION OF THE DRAWINGS

The present invention will be further described with reference to the accompanying drawings, in which.

DETAILED DESCRIPTION

Figure 1:
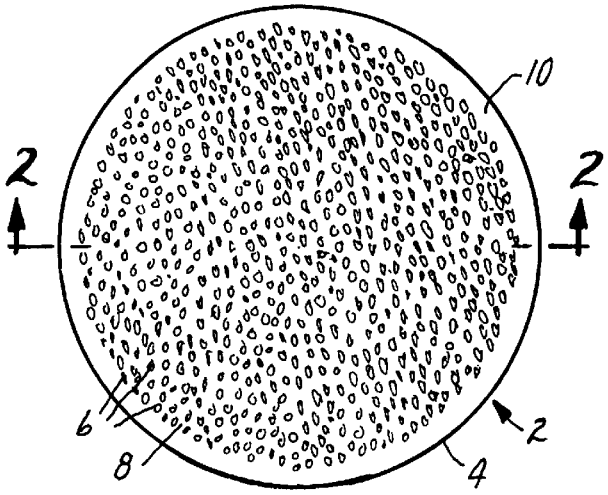
FIG. 1 is a top view of a conditioning disk according to the invention.
Figure 2:
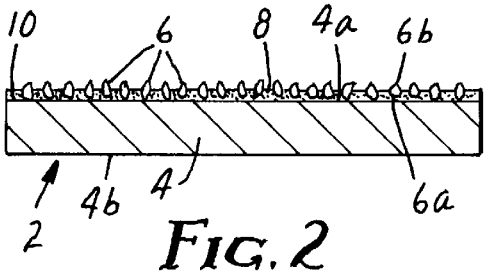
FIG. 2 is a detailed cross-sectional view taken along line 2—2 of FIG. 1.

Referring now to FIGS. 1 and 2, there is shown an abrasive article 2 in the form of a conditioning disk. The conditioning disk 2 includes a substrate 4 having opposite top 4*a* and bottom 4*b* generally planar surfaces. The substrate 4 is formed of any suitable material such as, for example, stainless steel. A plurality of abrasive particles 6 are arranged adjacent the top substrate surface 4*a* with a first surrounded portion 6*a* embedded in a matrix material 8 which serves to affix the particles to the substrate 4 and securely hold each particle in place, and a second exposed portion 6*b* projecting outwardly from the matrix material 8, thereby forming an abrasive surface. A particle free zone 10 is provided along the peripheral edge of the conditioning disk 2 to ensure adequate lateral support for the abrasive particles near the edge of the disk.

The matrix material 8 includes a sintered corrosion resistant powder and a brazing alloy. An inter-metallic compound of corrosion resistant powder and brazing alloy connects the brazing alloy with the sintered corrosion resistant powder, and a chemical bond connects the brazing alloy with the abrasive particles. The term "chemical bond" as used herein is used to describe a bond formed by molecular interaction between the brazing alloy and the abrasive particles. The term chemical bond includes cases where the brazing alloy interacts with a reduced state of the abrasive particles for example, the carbide. For example, the chromium in the brazing alloy interacts with the carbon on the surface of the diamond and forms chromium carbide. In some instances the brazing alloy may be responsible for any reduction or oxidation. A chemical bond is superior to a purely mechanical attachment in which the matrix material serves to hold the particles in place by its structural arrangement around the individual particles. With a mechanical attachment, certain particles, depending on their shape, will not be securely held in place and will therefore have a tendency to become dislodged during operation of the conditioning disk. With a chemical bond, in contrast, a molecular bond is formed at the interface between the brazing alloy and the abrasive particles and, as a result, chemical bonds exhibit stronger holding properties which are independent of the shape of the abrasive particles.

To form the chemical bond, the composition of the brazing alloy includes a sufficient quantity of an element known to react with the particular abrasive particle used. For example, if diamond abrasive particles are used, the brazing alloy includes a high content (i.e. greater than 7% by weight) of at least one of the following elements which may react with and form a chemical bond with the diamond: chromium, tungsten, cobalt, titanium, zinc, iron, manganese, or silicon. If cubic boron nitride abrasive particles are used, the brazing alloy may include aluminum, boron, carbon, or silicon to form the chemical bond with the abrasive particles, and if aluminum oxide abrasive particles are used, the brazing alloy may include aluminum, boron, carbon, or silicon. Of course, the brazing alloy may further include various non-reactive materials.

The corrosion resistant powder is admixed with the brazing alloy to improve the bonding properties, enhance the strength, improve the corrosion resistance properties, and reduce the cost of the matrix material. The quantity of corrosion resistant powder in the matrix material can range from generally 5 to 99% by weight. Alternatively, the matrix material can include 40–98% corrosion resistant powder by weight, or 50–95% corrosion resistant powder by weight. A specific embodiment of the invention includes 80% corrosion resistant powder by weight and 20% brazing alloy.

Figure 3:
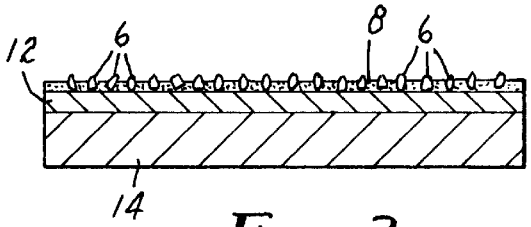
FIG. 3 is a detailed cross-sectional view of an alternate embodiment of the conditioning disk of FIG. 1.

In the embodiment shown in FIG. 3, the abrasive particles 6 and matrix material 8 are affixed to a flexible substrate 12 which is mounted on a rigid carrier 14. The substrate 12 is formed of any suitable material such as, for example, stainless steel foil. The carrier 14 provides rigid support for the substrate 12 and is formed of any suitable material such as, for example, a stainless steel shim having of a thickness sufficient to provide adequate structural support. The flexible substrate 12 is affixed to the carrier 14 with an adhesive such as, for example AF-163-2K aerospace epoxy which is available from Minnesota Mining and Manufacturing Company, St. Paul, Minn. The substrate 12 may also be attached to the carrier 14 with known mechanical fasteners such as rivets or screws.

Figure 4:
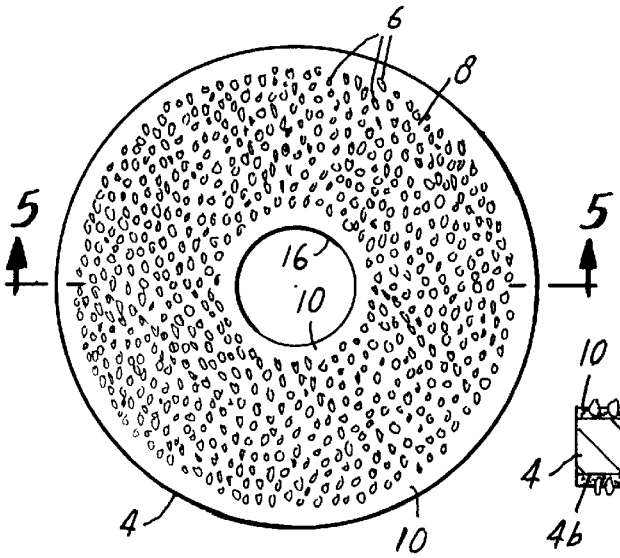
FIG. 4 is a top view of a third embodiment of the invention.
Figure 5:
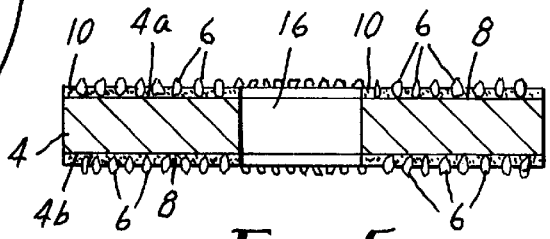
FIG. 5 is a detailed cross-sectional view taken along line 5—5 of FIG. 4.

A third embodiment of the invention shown in FIGS. 4 and 5 is similar to the conditioning disk of FIG. 2 except the conditioning disk of FIGS. 4 and 5 contains a centrally located circular opening 16, and includes abrasive particles affixed to both the top 4*a* and bottom 4*b* surfaces of the substrate 4.

Figure 6:
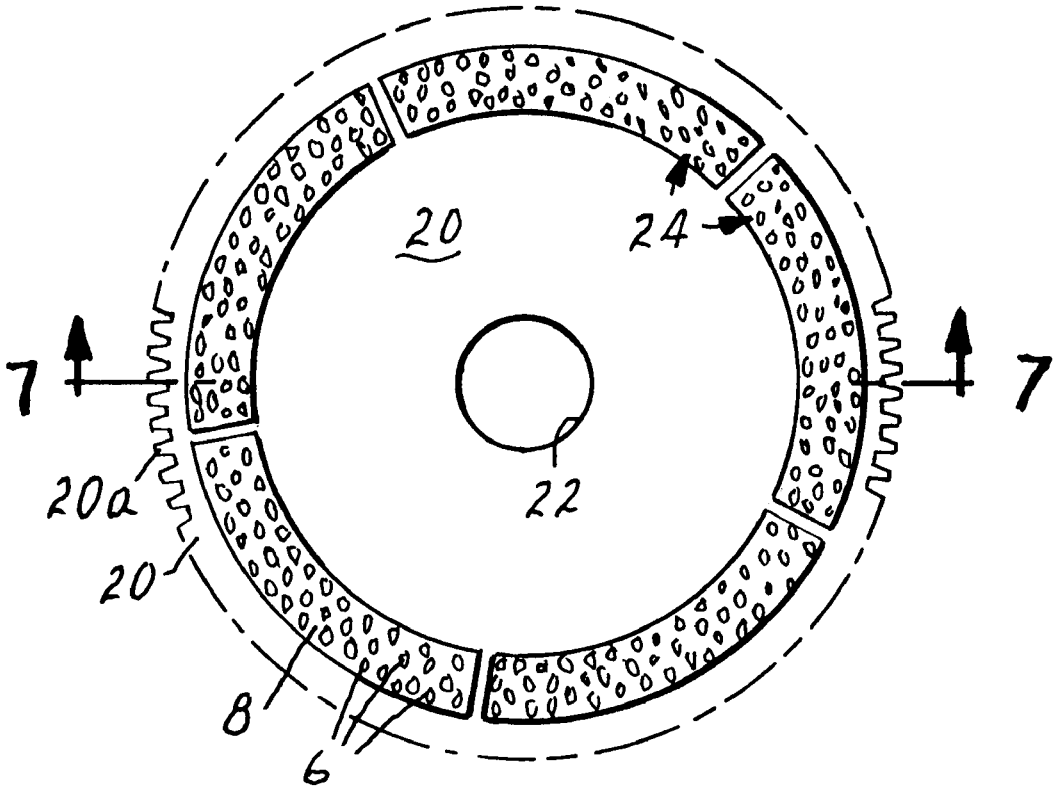
FIG. 6 is a top view of a fourth embodiment of the invention.
Figure 7:
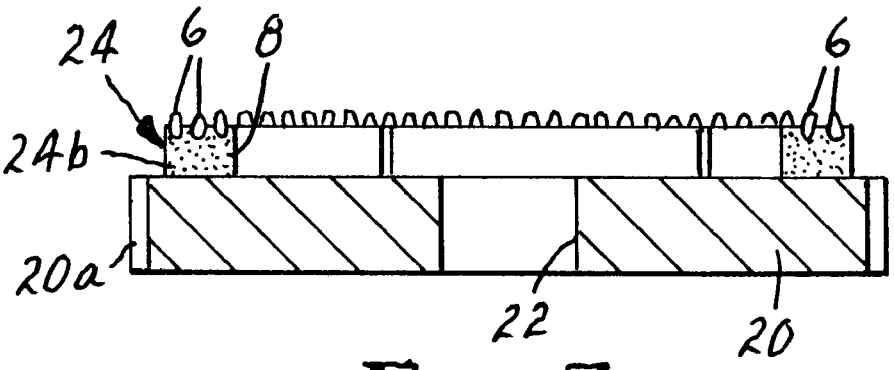
FIG. 7 is a detailed cross-sectional view taken along line 7—7 of FIG. 6.

FIGS. 6 and 7 show a fourth embodiment of a conditioning disk in which the abrasive particles 6 and matrix material 8 are affixed to a gear-shaped carrier 20 having a plurality of gear teeth 20*a,* and containing a centrally located circular opening 22. The carrier 20 is formed of, for example, a polycarbonate such as LEXAN™. Those skilled in the art will recognize that other synthetic plastic materials or metals may be used. The abrasive particles 6 and matrix material 8 are formed into rigid abrasive segments 24 which are mounted directly to the carrier 20 using any suitable technique such as adhesive or mechanical fasteners. Each segment 24 includes an abrasive portion 24*a* which contains the abrasive particles 6, and an in situ substrate portion 24*b* formed of matrix material. Alternatively, the abrasive particles 6 and matrix material 8 may be arranged along a substrate (not shown) formed of a suitable material such as the stainless steel foil described in reference to FIG. 3 and affixed to the carrier 20 in a similar manner.

A method of forming the abrasive articles according to the invention includes first providing the matrix material on the substrate and then arranging the abrasive particles in the matrix material so that a first portion of each particle is embedded in and surrounded by the matrix material and a second exposed portion extends outwardly from the matrix material. The matrix material includes a corrosion resistant powder and a brazing alloy which includes an element which reacts with and forms a chemical bond with the particular abrasive particle as discussed previously with reference to FIGS. 1 and 2. The abrasive particles may be randomly distributed on the substrate, or arranged in a predetermined pattern using a known method such as, for example, the method disclosed in U.S. Pat. No. 4,925,457 to deKok et al., the contents of which are hereby incorporated by reference. Heat and pressure are then applied to the substrate, matrix material, and abrasive particles, causing the brazing alloy to transition from its solid to its liquid phase. The liquid brazing alloy then flows into intimate contact with and surrounds a portion of each abrasive particle. When the brazing alloy cools and returns to its solid phase, the brazing alloy serves to hold each abrasive particle in place by providing structural support in the form of a mechanical attachment. In addition, the constituent element of the brazing alloy selected to react with the abrasive particles forms a chemical bond with each abrasive particle, thereby providing an additional mechanism to securely hold each particle in place which is independent of the shape of the particle. The liquid brazing alloy also flows between the interstices of the corrosion resistant powder and forms an inter-metallic compound consisting of brazing alloy and corrosion resistant powder at the braze-powder interface. The heat and pressure also cause the corrosion resistant powder to sinter, that is, the corrosion resistant powder forms a homogeneous mass by partially welding the individual particles corrosion resistant powder together without melting.

EXAMPLE

In a specific embodiment of the invention, 80/100 diamond abrasive particles were embedded in a matrix material comprising 20% by weight brazing alloy and 80% by weight stainless steel powder. The brazing alloy used was AMDRY alloy No. 767, available from Sulzer Metco, Westbury, N.Y., which includes nickel, phosphorous, and chromium. The chromium serves to react with and form a chemical bond with the diamond abrasive particles. The stainless steel powder used was Ancor 434L-100, available from Hoeganaes Co., Riverton, N.J. The diamond abrasive particles, brazing alloy, and stainless steel powder were then heated to a temperature in the range of generally between 900 and 1100 degrees Celsius, pressurized to a pressure in the range of generally between 75 and 400 kg/cm$^2$, and maintained at these conditions for a time period of generally between 3 and 15 minutes to allow one or more of the following to occur: (1) the stainless steel to become sintered; (2) the brazing alloy to flow around, react with, and form chemical bonds with the abrasive particles; (3) the brazing alloy to flow through the interstices of the sintered stainless steel powder; and (4) the brazing alloy to form an inter-metallic compound with the sintered stainless steel powder. These events may occur simultaneously or in any order.

A specific technique for providing the heat and pressure treatment includes covering the abrasive particles and matrix material with an electrically conducting layer of material capable of conforming to the surface contours of the abrasive particles and matrix material, such as graphite paper available from UCAR Carbon Co., Inc., Cleveland, Ohio. Heat is generated by applying an electric current to the layer of graphite paper, and pressure is provided by applying pressure to the graphite paper which, in turn, transmits the pressure to the abrasive particles and matrix material. After the heating and pressurizing step, the conforming conductive layer is removed using any known technique such as sandblasting, pressure washing, high pressure waterjet cleaning, or dissolving the layer with a suitable chemical solution, thereby exposing the abrasive particles.

The method can further include arranging the abrasive particles on the substrate to provide a particle free zone containing no abrasive particles, and then cutting through the particle free zone in order to obtain an abrasive article having a particular configuration. By providing a particle free zone, the cutting operation does not dislodge any particles or otherwise affect the support for the particles. Lastly, the method can include mounting the substrate on a carrier using any suitable fastening means including adhesive or mechanical fasteners.

It will be apparent to those of ordinary skill in the art that various changes and modifications may be made without deviating from the inventive concept set forth above. Thus, the scope of the present invention should not be limited to the structures described in this application, but only by the structures described by the language of the claims and the equivalents of those structures.

What is claimed is:

1. An abrasive article, comprising:

(a) a substrate having opposite generally planar top and bottom surfaces; and (b) a plurality of abrasive particles arranged on at least a portion of at least one of said top and bottom substrates surfaces and affixed thereto with a matrix material, said matrix material comprising a brazing alloy and a corrosion resistant powder, wherein said corrosion resistant powder comprises from 40% to 98% by weight of said matrix material.

2. An abrasive article as defined in claim 1, wherein said corrosion resistant powder is sintered, said sintered corrosion resistant powder is connected with said brazing alloy with an inter-metallic compound comprising corrosion resistant powder and brazing alloy, and said brazing alloy is connected with said abrasive particles with a chemical bond, thereby securely holding said abrasive particles in place relative to said substrate.

3. An abrasive article as defined in claim 2, wherein said corrosion resistant powder is selected from the group consisting of stainless steel, titanium, zirconium, tungsten carbide, nichrome, and mixtures thereof.

4. An abrasive article as defined in claim 3, wherein said abrasive particles are diamonds and said brazing alloy comprises at least one element selected from the group consisting of chromium, tungsten, cobalt, titanium, zinc, iron, manganese, and silicon.

5. An abrasive article as defined in claim 3, wherein said abrasive particles are cubic boron nitride and said brazing alloy comprises at least one element selected from the group consisting of titanium, silicon, and boron.

6. An abrasive article as defined in claim 3, wherein said abrasive particles are aluminum oxide and said brazing alloy comprises at least one element selected from the group consisting of aluminum, carbon, silicon, and boron.

7. An abrasive article as defined in claim 3, wherein said substrate is formed of a corrosion resistant metal.

8. An abrasive article as defined in claim 3, wherein said substrate is formed of said matrix material.

9. An abrasive article as defined in claim 3, wherein said substrate is affixed to a carrier.

10. An abrasive article as defined in claim 9, wherein said substrate is affixed to said carrier with an adhesive.

11. An abrasive article as defined in claim 10, wherein said carrier is formed of one of stainless steel and polycarbonate.

12. An abrasive article as defined in claim 11, wherein said carrier has a generally circular shape and includes an outer edge surface having a plurality of teeth.

13. An abrasive article as defined in claim 3, wherein each of said top and bottom substrate surfaces include a plurality of abrasive particles fixed thereto.

14. An abrasive article as defined in claim 3, wherein said substrate includes a particle free zone, thereby allowing said substrate to be cut to a predetermined shape by cutting through said particle free zone.

15. An abrasive article as defined in claim 14, wherein said substrate has a generally circular shape and said particle free zone is provided along the peripheral edge of said substrate.

* * * * *